United States Patent [19]

Cronin et al.

[11] Patent Number: 4,526,432

[45] Date of Patent: Jul. 2, 1985

[54] ELECTRICAL CONNECTOR ASSEMBLY FOR FLAT CABLES

[75] Inventors: Michael J. Cronin, Sherman Oaks; Victor W. Hamra, North Hollywood, both of Calif.

[73] Assignee: Lockheed Corporation, Burbank, Calif.

[21] Appl. No.: 107,260

[22] Filed: Dec. 26, 1979

[51] Int. Cl.[3] ..... H01R 13/621

[52] U.S. Cl. ..... 339/75 M; 339/17 F; 339/94 M

[58] Field of Search ..... 339/17 F, 176 MR, 94 M, 339/256 R, 256 RT, 75 M

[56] References Cited

U.S. PATENT DOCUMENTS

| | | | |
|---|---|---|---|
| 3,701,964 | 10/1972 | Cronin | 339/94 M X |
| 4,012,093 | 5/1977 | Crane | 339/17 F |
| 4,125,310 | 11/1978 | Reardon et al. | 339/17 F X |

*Primary Examiner*—Eugene F. Desmond

*Attorney, Agent, or Firm*—Louis L. Dachs

[57] ABSTRACT

The invention is an electrical connector assembly (10) for coupling flat cable conductors (60) to electrical terminals (40). The invention comprises a receptacle (12) having a dielectric surface (31) with a pattern of first contact pads (33) extending therefrom coupled to the electrical terminals (40). A flat conductor cable (60) is provided having a pattern of second contact pads (64) mounted to a lower side (63), which are in a geometric pattern corresponding to the pattern of the first contact pads (33). A pressure means (72, 76) is provided to force the first and second contact pads (33, 64) into intimate contact, thereby electrically connecting the flat cable conductors (67) to the electrical terminals (40). The pressure means preferably comprises a resilient compression member (72) movably attached to a screw cap cover (76) which is adapted to engage the receptacle (12), such that upon the engagement of the cover (76) with the receptacle (12) the resilient compression member (72) forces the first and second contact pads (33, 64) together electrically connecting the flat and round cable conductors (67, 44).

9 Claims, 11 Drawing Figures

FIG. 3
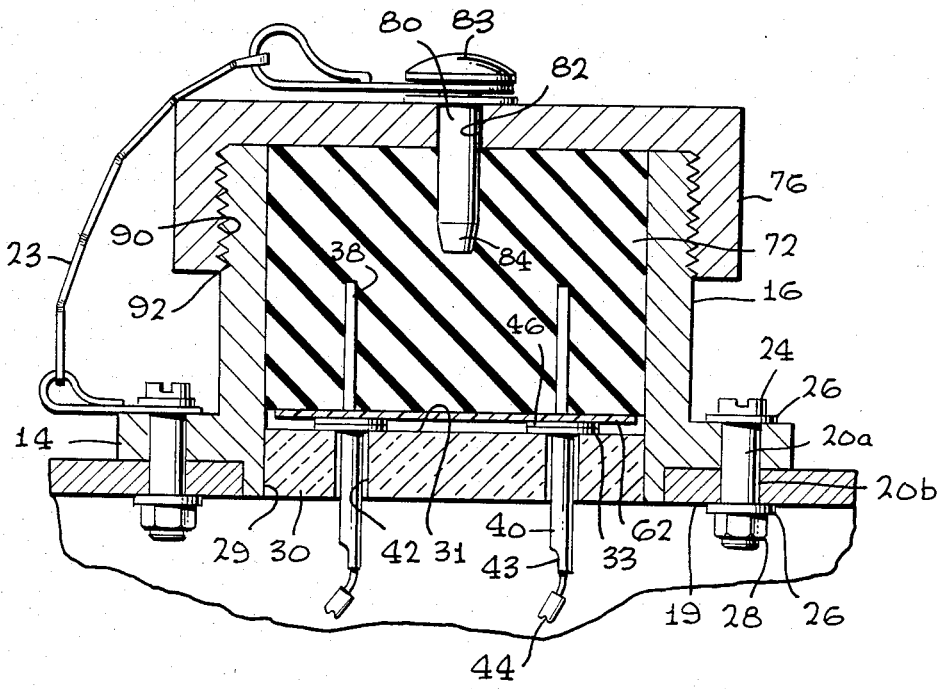
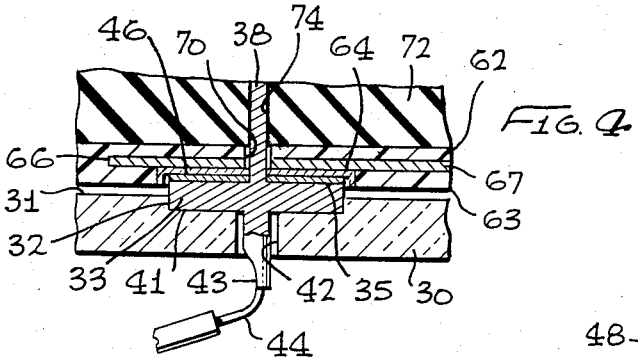
FIG. 4
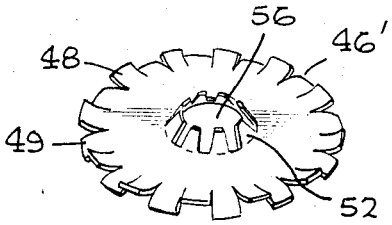
FIG. 5
FIG. 6
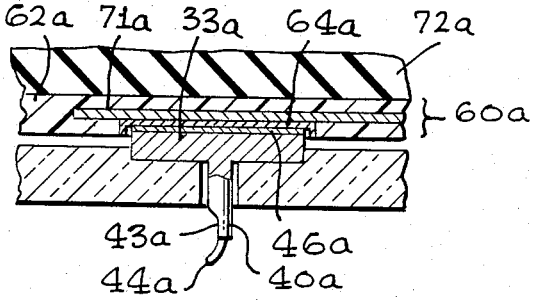

FIG. 8
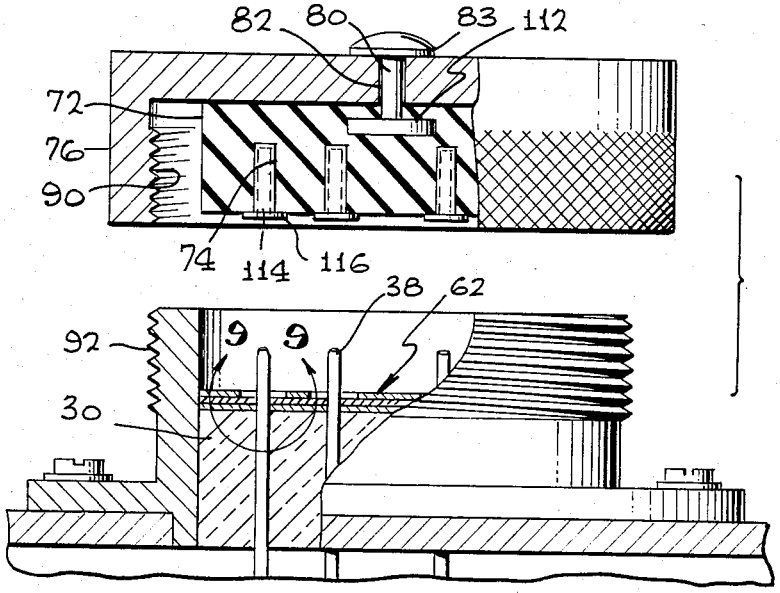
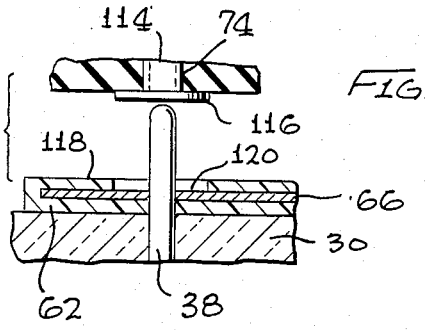
FIG. 9
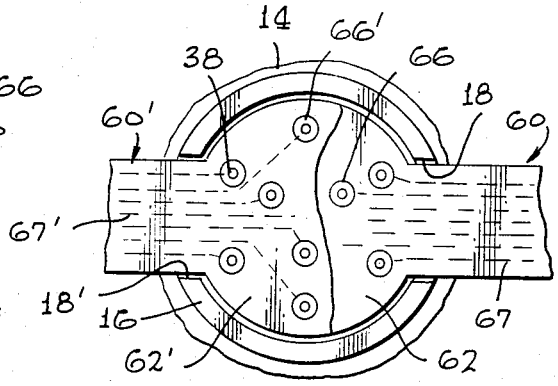
FIG. 10
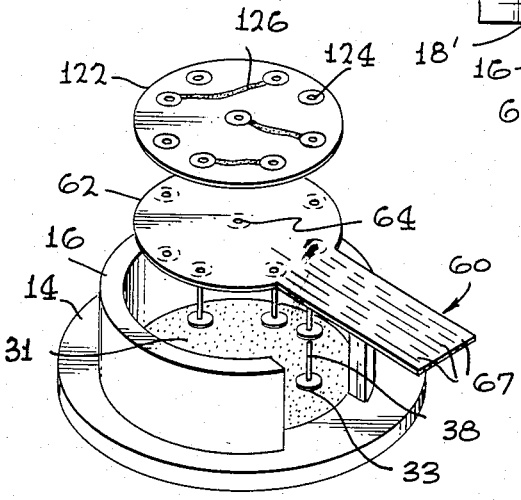
FIG. 11

ELECTRICAL CONNECTOR ASSEMBLY FOR FLAT CABLES

TECHNICAL FIELD

The invention relates generally to the field of electrical wiring systems and more particularly to a connector assembly for flat-wire cable systems.

BACKGROUND ART

Flat cable wiring systems are gaining wide acceptance and have numerous advantages over conventional round wire systems, some of which are compactness, less weight and lower costs to manufacture. One of the difficulties encountered when using flat cable wiring systems is integrating them with round cable wiring systems, or, of course, with other flat cable systems.

Much of this problem has been overcome by use of the invention disclosed in U.S. Pat. No. 3,701,964, Flat Cable Wiring System, by M. Cronin, assigned to the same assignee as the present invention. As disclosed therein, the conductors are terminated at apertured contact pads and connected to a first set of pin-type terminals on a mounting board. The round wires are terminated in conventional eyelets which are connected to a second set of pins on the mounting board. The flat and round conductors are interconnected by means of a programmable flexible printed circuit or circuit board interposed between the two sets of individual pins. The programmable circuit provided by the board or flexible circuit and wires are secured by a resilient compression member and a cover bolted to the mounting board.

This prior invention, however, did not solve the problem of connecting flat cable to components (so-called "black boxes") that must be readily removed, such as radio receivers, radar consoles and instruments located in the flight station of an aircraft. For this type of application, the prior art device had certain shortcomings. For example, when the component was removed, a number of loose parts from the connector assembly would remain i.e., the cover and compression pad, which could be lost or damaged.

Other prior art designs include, for example, the design shown in U.S. Pat. No. 3,275,968, Connector for a Flexible Flat Cable, by W. S. McCaughey. As disclosed therein, the insulation is removed from the end of the flat cable, and the end is bonded to a support member. A receptacle is mounted to the electronic component, which contains wire-type spring contacts for terminating the round wire conductors. Engagement of the support member of the receptacle is accomplished by means of a coupling nut which forces the flat wire into parallel engagement with the contacts. The main disadvantage of this prior device is that the parallel engagement of the flat wire with the contacts necessitates a long connector assembly.

On the other hand, the device shown and described in U.S. Pat. No. 3,235,833, Cable and Connector Therefor, by R. A. Elm, comprises a relatively flat connector. Elm requires the precise alignment of the flat cable on a first body member. A second body member having fork-like contacts is placed over the first body such that the prongs of the contact pierce the cables and make sliding contact with the individual conductors. This method has several drawbacks that would make it undesirable to use with many types of flat wire conductor cables. For example, some insulation material is quite tough, and would therefore be difficult to pierce. Other flat cables incorporate very thin plated flat ribbon conductors which could easily be broken by such a mechanical connection. Furthermore, the quality of the electrical contact between the contacts and the ribbon conductor would be suspect, to the degree that total loss of contact could ensue from repeated disconnections and reconnections.

In view of the shortcomings of the aforementioned prior art devices, there is a need for an improved means for the interconnection of flat wire cables with related equipment.

Thus, it is a primary object of this invention to provide a novel and improved flat cable electrical connector assembly that overcomes the deficiencies of prior art devices of a generally similar character.

It is another object of this invention to provide a novel and improved flat cable connector assembly that precludes damage to the flat cable or to the conductors therein during assembly.

Still another object of this invention is to provide a novel and improved flat cable electrical connector assembly that has improved electrical contact between the flat cable conductors and terminals within the connector.

Yet another object of the invention is to provide a novel and improved electrical cable connector of minimal volume.

DISCLOSURE OF INVENTION

The invention comprises of an electrical connector assembly for coupling flat cable conductors to electrical terminals, connector pins, or the like. A receptacle portion, having a dielectric surface with a plurality of conductive contact pins perpendicularly extending therefrom, is adapted to be coupled to the electrical terminals. The contact pins have a like number of electrical contact pads contiguous therewith. A flat conductor cable is provided having a pattern of second contact pads mounted to a lower side, which are in a geometric pattern corresponding to the pattern of the first contact pads. A pressure means is provided to force the second contact pads on the lower side of the cable into intimate contact with the first contact pads, thereby electrically connecting the flat cable conductors to the electrical terminals. The pressure means preferably comprises a resilient compression member attached to a screw cap cover which offers high mechanical advantage. Thus, upon engagement of the cover with the receptacle, the resilient compression member forces the first and second contact pads together so as to electrically connect the flat cable conductors with the terminals.

To effect a wiping-contact action between the first and second contact pads, washers of a concave design and having a spring-like action are electrically attached to the connector pins. These spring washers may co-operate solely with the connector pins and the second contact pads of the flat cable or, in another configuration, the spring washers may be loose (clearance) fit over the connector pins and co-operate as an interface between the first and second contact pads.

To provide additional electrical contact between the flat cable and the connector pins, the flat cable may be prepared to provide top side and lower side pads, with such pads interconnected by a plated-through hole process. The top side pad may be the exclusive contact with connector pin or may co-operate dually with the lower pad.

The novel features which are believed to be characteristic of the invention both as to its organization and to its method of operation, together with further objects and advantages thereof, will be better understood from the following description considered in connection with the accompanying drawings, in which presently preferred embodiments of the invention are illustrated by way of examples.

BRIEF DESCRIPTION OF DRAWINGS

FIG. 3 is a cross-sectional view of the connector assembly of FIG. 1, taken along line 3—3 of FIG. 2;

FIG. 4 is a cross-sectional view of a portion of the connector assembly taken along line 4—4 of FIG. 2;

FIG. 5 is an enlarged perspective view of the wiper washer portion of the apparatus shown in FIG. 1;

FIG. 6 is a modified cross-sectional view of a portion of the electrical connector assembly along the line 4—4 of FIG. 2, showing a first alternate method of making an electrical connection between the flat wire cable conductors and the electrical terminals;

FIG. 8 is an exploded view, partly in section, of a modified connector assembly;

FIG. 9 is an enlarged view of the region 9—9 of FIG. 8;

FIG. 10 is a plan view, partially broken away, illustrating the joining of two flat wires utilizing the present invention;

FIG. 11 is an exploded prospective view illustrating the use of a programmable circuit disc in the present invention.

BEST MODE OF CARRYING OUT THE INVENTION

Figure 1:
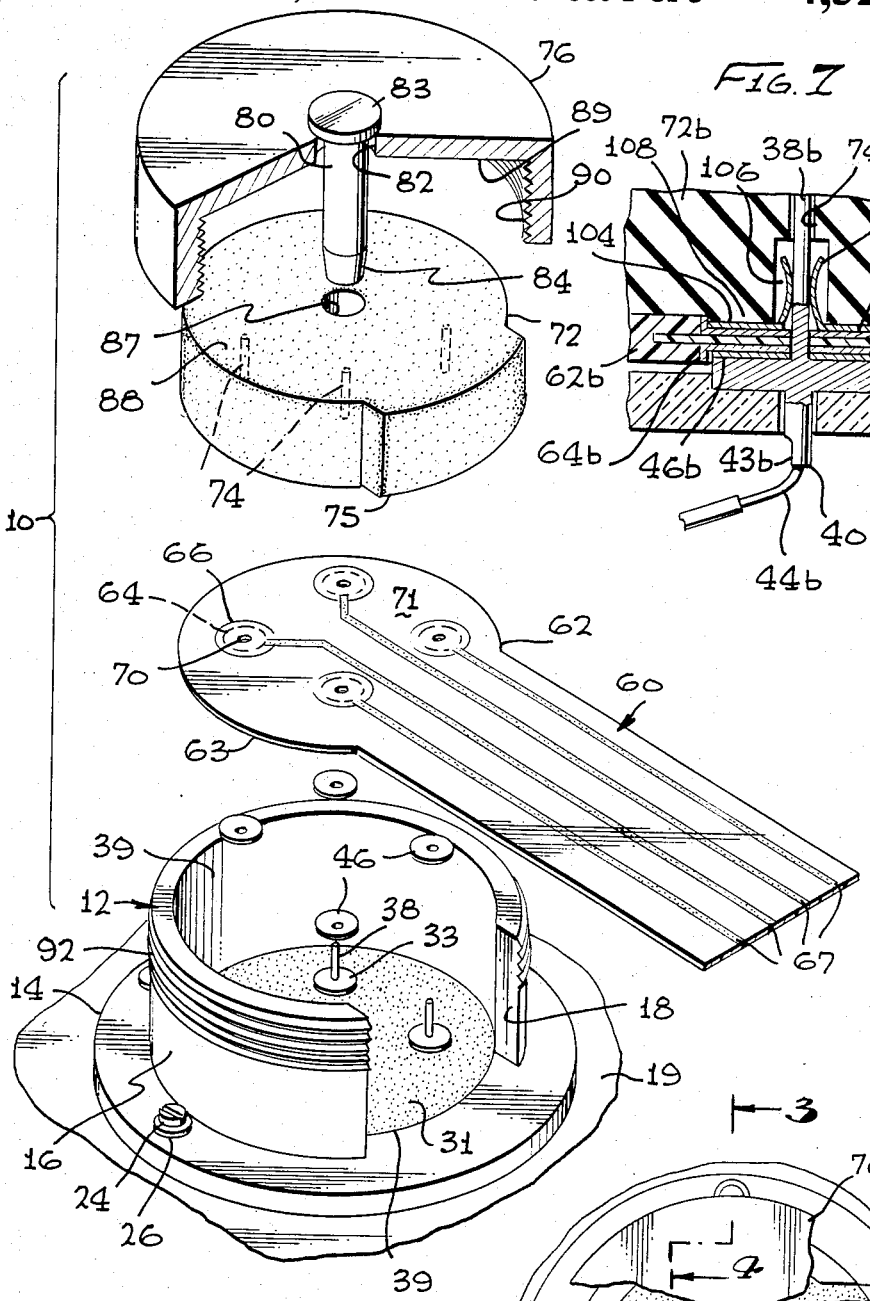
FIG. 1 is an exploded view of a connector assembly constructed in accordance with the present invention.
Figure 2:
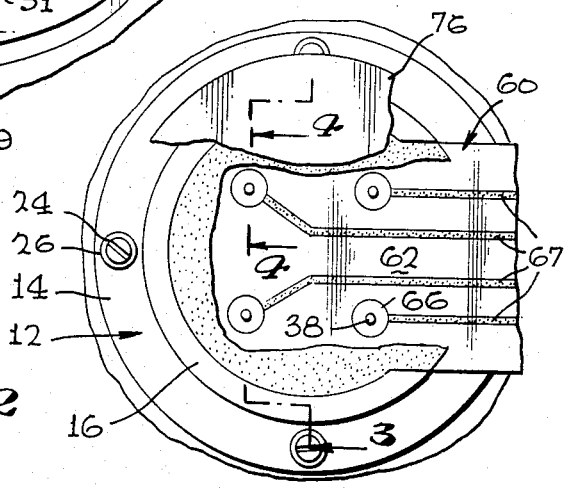
FIG. 2 is a top view of the connector assembly of FIG. 1 partially broken away to show the interior thereof.

Referring now to FIGS. 1, 2 and 3, it can be seen that the connector assembly, designated by numeral 10, comprises a receptacle portion 12 having a base 14 upon which is mounted a hollow cylindrical member 16. The hollow cylindrical member 16 has an arcuate section removed to form a notch 18, which permits entry of the flat cable 60 into the connector housing. The receptacle portion 12 is adapted to be mounted on any suitable substrate which typically may comprise an electrical component enclosure 19. In the example shown, mounting is accomplished by a plurality of holes 20*a* and 20*b* in the base 14 of receptacle 12 and enclosure 19, respectively. Screws 24, with lock washers 26 and nuts 28, attach the receptacle 12 to the assembly 19.

As is shown in FIGS. 1-3 and FIG. 4, which is a cross-sectional view of a portion of the connector assembly 10 taken along line 4—4 of FIG. 2, it can be seen that the base 14 has an aperture 29 in which is mounted a bushing 30 having an upper surface 31. The bushing 30 is preferably made of an insulating or dielectric material such as hard rubber, and is bonded in place in aperture 29. The bushing 30 incorporates a plurality of apertures 23, one of which is shown in FIG. 4, into which are bonded contact pads 33 made of a conductive material such as copper and which slightly protrude above the surface 31 of the bushing 30. Extending from the upper surfaces 35 of the pads 33 are pins 38. Extending from the lower surfaces 41 of the pads 33, through apertures 42 in the bushing 30, are conductive pins 40 terminating round wires 44.

A multiconductor flat cable 60 terminates in an end portion 62 configured to fit within the recess 39 of the cylinder 16. Mounted on the lower surface 63 of the end portion 62 are a plurality of spaced-apart conductor pads 64 (one of which is shown in FIG. 4), the locations of which are complementary to that of conductor pads 33. The conductor pads 64 are electrically connected to the ends 66 of the corresponding conductors 67 carried on or embedded within the cable 60. The pads 64 may be formed by making a circular recess, such as by removing a portion of the insulation below the ends 66 in the cable 60, and plating the recess with a layer of conductive metal such as copper. The pads 64 and cable 60 are provided with apertures 70 which allow pins 38 to pass therethrough.

The upper surface 71 of the end portion 62 of the cable 60 interfaces with a resilient compression member 72, made, for example, of an elastomeric material, also adapted to fit within the recess 39 of the cylinder 16. The member 72 has an array of clearance holes 74 complementary to the array of pins 38. The member 72 has a protrusion 75 adapted to fill the notch 18, thus acting as a seal in a manner to be subsequently described.

A cover 76, attached to the base 14 by a flexible cord 73, is removably engageable with member 72 by means of retaining pin 80. The pin 80 extends through a aperture 82 in the cover 76 and terminates in a flange 83 having a diameter larger than the aperture 82. End 84 of the pin 80 extends into a hole 87 in the member 72. Member 72 may be separate from cover 76 or may be bonded thereto to make member 72 integral with cover 76, by bonding end 84 into hole 87, such that a slight gap exists between the top surface 88 of the member 72 and the inner surface 89 of the cover 76. The cover 76, thus joined, is free to rotate and translate relative to the member 72. The cover 76 has an internally threaded member 90 which is adapted to mate with external threads 92 on the cylinder 16.

To assemble the connector 10, cable 60, member 72 and cover 76 are connected to the receptacle 12 by placing the cable 60 over the pins 38 and installing the member 72 in the recess 39 of the cylinder 16 over the pins 38 so that it sets lightly on the cable 60. The cover 76 is then threaded onto the cylinder 16 to cause the member 72 to urge pads 64 into intimate contact with the surfaces of confronting pads 33 and thus into electrical contact with the pins 38. Continued torquing of the cover 76 also causes protrusion 75 of the member 72 to compress against the cable 60 sealing off the recess 39. The action of screwing the cover 76 onto the cylinder 76 provides a high mechanical gain which ensures good electrical contact between the cable 60 and the connector assembly 10 mounted to the enclosure 19.

The electrical contact interface can be made more efficient by use of the wiping action on pads 33 and 64 provided by concave spring washers 46 shown in FIG. 1. The washers 46 may be eliminated in another configuration by providing a spring-contact flange on the base of pins 38. Referring to FIG. 5 which is an enlarged view of a spring washer 46′ that may be pressed over the pin of a conventional electrical connector, such as pin 38 used herein, it can be seen that the washer 46′ is essentially flat and incorporates circumferential tabs 48 and 49 alternately protruding upward and downward, respectively, from the plane of the washer 46'. Additionally, the washer 46' has a series of tabs 52 protruding upward forming an aperture 56 in the center of the washer 46' which is slightly less in diameter than the pin 38. The washer 46' is made of conductible and yieldable material such as beryllium copper, although other materials are suitable. When the washer 46' is slid over the pin 38, the tabs 52 yield allowing the washer 46' to be slid down the pin 38 until it bottoms out on the pad 34. But, because the tabs 52 protrude upward and the aperture 56 is slightly less in diameter than the pin 38, it will resist removal because it tends to "dig" into the pin 38 and thus is essentially locked in place. Threading the cover 76 on to the cylinder 16 will cause the member 72 to force pad 64 into the washer 46', causing tabs 48 and 49 to flatten out into the plane of the washer 46' and in so doing move outward and wipe the surfaces of the confronting pads 33 and 64. If desired, as stated previously, the washers 46 can serve as the only contact pad on pin 38 and the pads 33 can be eliminated. The wiping action creates a good electrical contact by removing any accumulated dirt or oxidation on the pads.

In some applications there may be limited space for installing electrical connector assemblies. It is possible, however, to reduce the height of the connector assembly by eliminating the pins 38, as shown in the embodiment illustrated in FIG. 6, which is a modified cross-sectional view of a portion of the connector assembly 10 along line 4—4 of FIG. 2. A washer 46*a* is brazed or otherwise physically and electrically connected to each of the contact pads 33*a*, with the contact pads 64*a* being formed as previously discussed. The resilient compression member 72*a* is bonded, in this embodiment, directly to the upper side 71*a* of the end 62*a* of cable 60*a*. Thus, with the elimination of the pins 38 for attaching the washer 46*a*, the height of the member 72*a* and thus the connector assembly 10 can be reduced.

Figure 7:
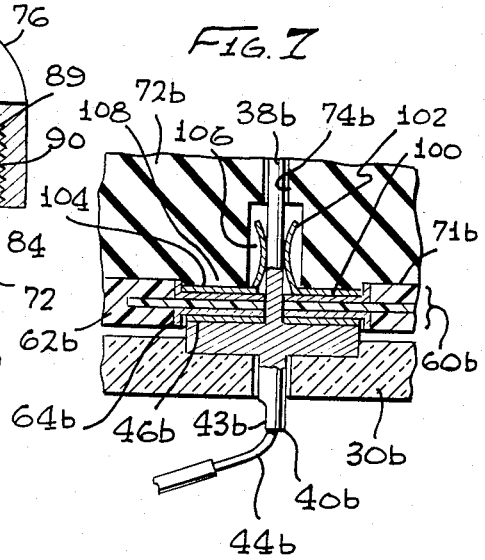
FIG. 7 is a modified cross-sectional view through a portion of the electrical connector assembly along the line 4—4 of FIG. 2 showing a second alternate method of coupling the flat wire cable to the terminals.

To further insure a good electrical contact between the cable 60 and the contact pads 33 redundant contact paths can be provided. Illustrated in FIG. 7 is a modified cross-sectional view of a portion of the connector assembly 10 taken along line 4—4 of FIG. 2. The side 71*b* of the end portion 62*b* of cable 60*b* incorporates additional contact pads 100 having a location pattern identical with, and formed in a manner similar to, pads 64*b*. Coupled to pads 100 are female pin receptacles 102 adapted to electrically engage pins 38*b* having flanges 104 soldered or otherwise attached to the pads 100. Alternatively, the receptacles 102 can be spring-loaded contact fingers bonded to the compression member 72, in a manner described in FIG. 8 hereafter. The resilient compression member 72*b* is provided with a recess 106 to provide clearance for the receptacles 102, as well as apertures 74*b* adapted to receive pins 38*b*. Securing of the cable 60*b* to the compression member 72*b* can be accomplished by providing member 72*b* with a location pattern of protrusions 108 (complementing the location pattern of pads 100) which can be bonded to the flanges 104 of the receptacles 102. Thus, when the connector assembly 10 is assembled, the contact pads 64*b* are electrically coupled to the contact pads 33*b*, as previously discussed, and the receptacles 102 will engage pins 38*b* creating redundant electrical paths. Pads 64*b* and 100 can be coupled, if desired by a plated-through hole process, as stated previously.

It should be noted that if redundancy is not required, contact pads 64*b* and washer 46*b* and pads 33*b* can be eliminated, thereby relying on the connection between receptacles 102 and pins 38*b* for electrical continuity.

Referring now to FIGS. 8 and 9, in which a modified connector assembly is illustrated, the cover 76 is shown having a pin 80 extending through an aperture 82 and terminating in an upper flange 83, as shown previously, and a lower flange 112. The lower flange 112 is embedding in the resilient compression member 72 and rotatably couples member 72 to cover 76. Member 72 has an array of holes 74 therein, as shown previously, complementary to the array of pins 38 protruding above bushing 30. The holes 74 have bonded therein a plurality of spring loaded conductive sleeves 114 having flanged contact pads 116. As is shown in FIG. 9, the insulation 118 above the ends 66 of the conductors 67 embedded in the end portion 62 of the cable 60 is trepanned to provide contact regions 120 with which flanged contact pads 116 can mate. When the cover 76 is screwed down by threads 90 and 92, the conductive sleeves 114 slip over the ends of pins 38 and the compression member 72 urges the pads 116 into intimate contact with the contact regions 120.

In FIG. 10, two flat cables 60 and 60' are shown electrically coupled by means of the present invention. The cylindrical member 16 mounted on the base 14 has notches 18 and 18' therein to allow the insertion of end portions 62 and 62', of cables 60 and 60'. The ends 66, 66' of the conductor 67, 67' in the cables 60, 60' have top side and bottom side contact pads thereon connected by plated-through holes, not shown, so that the cables 60, 60' are electrically coupled to one another by engagement of the top side and bottom side contact pads and by the pins 38 engaging the plated through holes when the compression member 72 and the cover 76 are placed over and screwed down onto the cables 60, 60'. To provide additional electrical contact, the sleeves 114, shown in FIG. 8, and the spring washers 46, shown in FIG. 1, can also be utilized. It is apparent that a multiplicity of flat cables can be interconnected using such techniques.

In FIG. 11, the use of a programmable circuit disc is illustrated. As is seen, the end portion 62 of the cable 60 is inserted over the pins 38 so that the pads 64 contact the pads 33. A programmable disc 122 having an array of pads 124 complementary to the pins 38 is also inserted over the pins 38. The pads 124 are shown coupled in a preselected manner by wires or plated conductors 126 so that the flat conductors 67 can be electrically coupled to the round wires 44 (not shown) to provide a desired output.

While the electrical connector assembly has been described with reference to particular embodiments, it should be understood that such embodiments are merely illustrative as there are numerous variations and modifications which may be made by those skilled in the art.

INDUSTRIAL APPLICABILITY

The electrical connector assembly is useful for the interconnection of multiconductor flat cable and electrical pin terminal arrays.

We claim:

1. An electrical connector assembly comprising:

a receptacle having a surface and a pattern of first contact pads mounted to said surface terminating first electrical conductors, said pads having pins protruding therefrom;

a flat cable having first and second sides and a pattern of second contact pads mounted on a portion of said first side terminating second electrical conductors, said pattern of second contact pads having positions that are complementary to said first contact pads, said second contact pads and said cable having apertures adapted to receive said pins;

securing means adapted to urge said first and second contact pads together to electrically connect said first and second conductors; and wiper means adapted to be secured to said pins and to wipe both said first and said second contact pads when under compression.

2. The electrical connector assembly of claim 1 wherein said securing means comprises a resilient compression member adapted to receive said pins; and a cover means movably secured to said resilient compression member and adapted to engage said receptacle.

3. The electrical connector assembly of claim 1 further comprising:

a pattern of third apertured contact pads mounted on a portion of said second side of said flat cable terminating said second electrical conductors and complementary to said second contact pads; and contact means adapted to engage said third contact pads and said pins.

4. An electrical connector assembly comprising:

a dielectric member having a first substantially planar surface;

a plurality of conductive contact pins perpendicularly extending from said first planar surface and having contiguous therewith a like number of first electrical contact pads;

a flat cable comprising a flexible dielectric sheet and having first and second surfaces, a portion of said first surface have disposed thereon a pattern of second electrical contact pads connected to corresponding electrical conductors in said cable, said pattern of second electrical contact pads having locations which are complementary to those of said first electrical contact pads;

compression means confronting a portion of said second surface of said cable corresponding to said portion of said first surface and adapted to urge said first and second electrical contact pads together and thereby establish electrical continuity between said pins and the corresponding electrical conductors of said cable; and wiper means adapted to wipe at least one of said first and second contact pads when said compression means urges said first and second contact pads together.

5. The electrical connector assembly of claim 4 wherein said compression means comprises:

a resilient dielectric member having a planar surface which is substantially coextensive with said portion of said second surface of said cable; and means selectively engageable with said dielectric member for urging said first and second contact pads together.

6. The electrical connector assembly of claim 4 wherein said wiper means comprises a washer having compressible protruding tabs, said tabs adapted to cause a wiping action on said contact pads.

7. An electrical connector for electrically connecting at least one first pattern set of contact pads terminating first electrical conductors to a flat-cable end portion having first and second sides and a second pattern set of contact pads mounted on a portion of said first side terminating second electrical conductors, said first pattern set and said second pattern set having relative positions that are complementary, comprising:

said first set of contact pads including pins protruding therefrom;

a receptacle including a cylinder portion terminating at one end in a base portion, said base portion including, within the area defined by said cylinder end an integral dielectric portion having a first substantially planar surface to which said first set of contact pads are mounted, said cylinder portion including a notch in the wall thereof for receiving said flat cable end portion; and securing means adapted to urge said first and second sets of contact pads together, said securing means including compression means adapted to confront a portion of said second surface of said cable corresponding to said portion of said first surface and adapted to urge said first and second sets of electrically contact pads together and thereby establish electrical continuity between said pins and the corresponding electrical conductors of said cable, said compression means comprising a resilient dielectric compression member having a planar surface which is substantially coextensive with said portion of said second surface of said cable; and means selectively engageable with said dielectric compression member for urging said first and second contact pads together, said resilient compression member including means adapted to receive said pins;

wiper means adapted to forceably fit over said pins and wipe at least one of said first and second contact pads when said compression means urges said first and second contact pads together.

8. An electrical connector for electrically connecting at least one first pattern set of contact pads terminating first electrical conductors to a flat-cable end portion having first and second sides and a second pattern set of contact pads mounted on a portion of said first side terminating second electrical conductors, said first pattern set and said second pattern set having relative positions that are complementary, comprising:

said first set of contact pads including pins protruding therefrom;

a receptacle including a cylinder portion terminating at one end in a base portion, said base portion including, within the area defined by said cylinder end an integral dielectric portion having a first substantially planar surface to which said first set of contact pads are mounted, said cylinder portion including a notch in the wall thereof for receiving said flat cable end portion; and securing means adapted to urge said first and second sets of contact pads together, said securing means including compression means adapted to confront a portion of said second surface of said cable corresponding to said portion of said first surface and adapted to urge said first and second sets of electrical contact pads together and thereby establish electrical continuity between said pins and the corresponding electrical conductors of said cable, said compression means comprising a resilient dielectric compression member having a planar surface which is substantially coextensive with said portion of said second surface of said cable and means selectively engageable with said dielectric compression member for urging said first and second contact pads together, and said resilient compression member having pin contact means secured therein in a pattern complementary to said pattern of said pins and adapted to engage said first set of contact pads and pins, and wiper means adapted to forceably fit over said pins and wipe at least one of said first and second contact pads when said compression means urges said first and second contact pads together.

9. An electrical connector for electrically connecting at least one first pattern set of contact pads terminating first electrical conductors to a flat-cable end portion having first and second sides and a second pattern set of contact pads mounted on a portion of said first side terminating second electrical conductors, said first pattern set and said second pattern set having relative positions that are complementary, comprising:

said first set of contact pads including pins protruding therefrom, said connector including disc means having conductive apertures therein positioned complementary to said pins, said conductive apertures being coupled in a preselected manner to electrically couple electrical conductors;

a receptacle including a cylinder portion terminating at one end in a base portion, said base portion including, within the area defined by said cylinder end an integral dielectric portion having a first substantially planar surface to which said first set of contact pads are mounted, said cylinder portion including a notch in the wall thereof for receiving said flat cable end portion; and securing means adapted to urge said first and second sets of contact pads together, said securing means including compression means adapted to confront a portion of said second side of said cable corresponding to said portion of said first surface and adapted to urge said first and second sets of electrically contact pads together and thereby establish electrical continuity between said pins and the corresponding electrical conductors of said cable; and wiper means adapted to forceably fit over said pins and wipe at least one of said first and second contact pads when said compression means urges said first and second contact pads together.

* * * * *